US006199849B1

(12) United States Patent
Lebwohl et al.

(10) Patent No.: US 6,199,849 B1
(45) Date of Patent: Mar. 13, 2001

(54) DEVICE FOR MOMENTARILY MOUNTING A SLIDING DOOR TO A VEHICLE BODY

(75) Inventors: Kurt Lebwohl, Graz; Gerhard Spanner, Illz, both of (AT)

(73) Assignee: Chrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/162,670

(22) Filed: Sep. 29, 1998

(51) Int. Cl.[7] ..... B25B 1/20
(52) U.S. Cl. ..... 269/37; 269/905; 269/904
(58) Field of Search ..... 269/37, 905, 904, 269/329, 901; 254/39; 29/281.5

(56) References Cited

U.S. PATENT DOCUMENTS

| | | | | |
|---|---|---|---|---|
| 2,803,872 | * | 8/1957 | Massa | 269/37 |
| 2,824,536 | * | 2/1958 | Gamble | 269/37 |
| 4,569,553 | | 2/1986 | Speth et al. . | |
| 5,054,755 | * | 10/1991 | Hawkes | 269/904 |
| 5,536,061 | | 7/1996 | Moore et al. . | |
| 5,551,980 | * | 9/1996 | Turnbo | 269/905 |
| 5,558,372 | | 9/1996 | Kapes et al. . | |
| 5,605,363 | | 2/1997 | Kapes . | |
| 5,704,599 | * | 1/1998 | Slothower | 269/41 |
| 5,762,348 | * | 6/1998 | Echternacht | 269/905 |
| 5,826,306 | | 10/1998 | Faubert et al. . | |
| 5,832,668 | | 11/1998 | Faubert . | |

* cited by examiner

*Primary Examiner*—David A. Scherbel
*Assistant Examiner*—Lee Wilson
(74) *Attorney, Agent, or Firm*—Mark P. Calcaterra

(57) ABSTRACT

A device for momentarily mounting a sliding door to a B column of a vehicle body. This device allows to mount the sliding door to the vehicle body during manufacture of the vehicle such that it may be pivoted—similar to a pivotal vehicle door—between opening and closing positions so as to provide for easy access to the vehicle body and sliding door. The device comprises a securing mechanism for removably securing the device to the B column, a holding mechanism for removably holding the sliding door at the device, and pivot member for pivotally connecting said securing mechanism and the holding mechanism. The device is a structural unit which may be mounted and dismounted to and from the vehicle body in a very simple manner.

10 Claims, 5 Drawing Sheets

DEVICE FOR MOMENTARILY MOUNTING A SLIDING DOOR TO A VEHICLE BODY

BACKGROUND OF THE INVENTION

1. Field of the Invention

This invention relates to a device for momentarily mounting a sliding door to a vehicle body.

2. Background and Summary of the Invention

In the manufacturing process of vehicles it is usual to mount the vehicle doors to the vehicle body already before the vehicle is moved through the so-called finish area and in particular in the paint shop. At this time the vehicle doors should impede work at the vehicle as little as possible. With doors that are pivotally mounted to the vehicle body this is no problem insofar as the doors can be pivoted to an opening position so as to provide for easy access.

This is not possible with sliding doors. In a prior art system the sliding door was guided by means of rollers in sliding door rails of the vehicle body. This system was relatively complex both in structure and operation. In particular it impeded access to certain areas of the vehicle body and the door which made working in the finish area and in particular in the paint shop more difficult. Furthermore, such a system caused some severe accidents in that the sliding door was torn off from its anchoring means due to rollers being jammed.

It is an object of the present invention to provide a device for momentarily holding a sliding door to a vehicle body which impedes working at the vehicle body and the sliding door during the vehicle manufacturing process as little as possible. Furthermore, such device should be adapted to be operated and in particular to be mounted and dismounted in an extremely simple manner.

The invention provides a device for momentarily mounting a sliding door to the B column of a vehicle body, comprising a securing mechanism adapted to be removably secured to said B column, a holding mechanism for removably holding said sliding door and pivot means for pivotally interconnecting said securing mechanism and said holding mechanism so as to enable said sliding door held by said holding mechanism to be rotated between opening and closing positions when said securing mechanism has been secured to said B column, said securing mechanism, said holding mechanism and said pivot means forming a unitary structure.

Preferably, the securing mechanism includes an elongated securing member adapted to be secured to an inner surface of said B column so as to extend vertically, and a pair of spaced transverse arms extending from said securing member transversely so as to extend in a direction opposite of said sliding door when said securing member has been secured to said B column.

Preferably, the holding mechanism includes a pair of round brackets each having one end thereof pivotally connected to a free end of said transverse arms by said pivot means such that said round brackets extend about the B column within said vehicle when said securing member has been secured to said B column, and an elongated holding member being fixedly connected to respective other ends of said round brackets and adapted to removably hold said sliding door.

The device of the present invention allows to rotate the sliding door—in a manner similar to a door pivotally mounted to the vehicle body—between opening and closing positions. This provides for easy access to the vehicle so that respective working operations can be performed in a precise and reliable manner. Because the device is an integral structural unit, it may be easily mounted and dismounted to and from the vehicle body. Furthermore, the device of the invention substantially reduces the risk of accidents. dr

BRIEF DESCRIPTION OF THE DRAWINGS

Further objects and advantages of the present invention will become apparent to one skilled in the art upon reading the following specification and by reference to the following drawings in which.

DESCRIPTION OF THE PREFERRED EMBODIMENT

Figure 5:
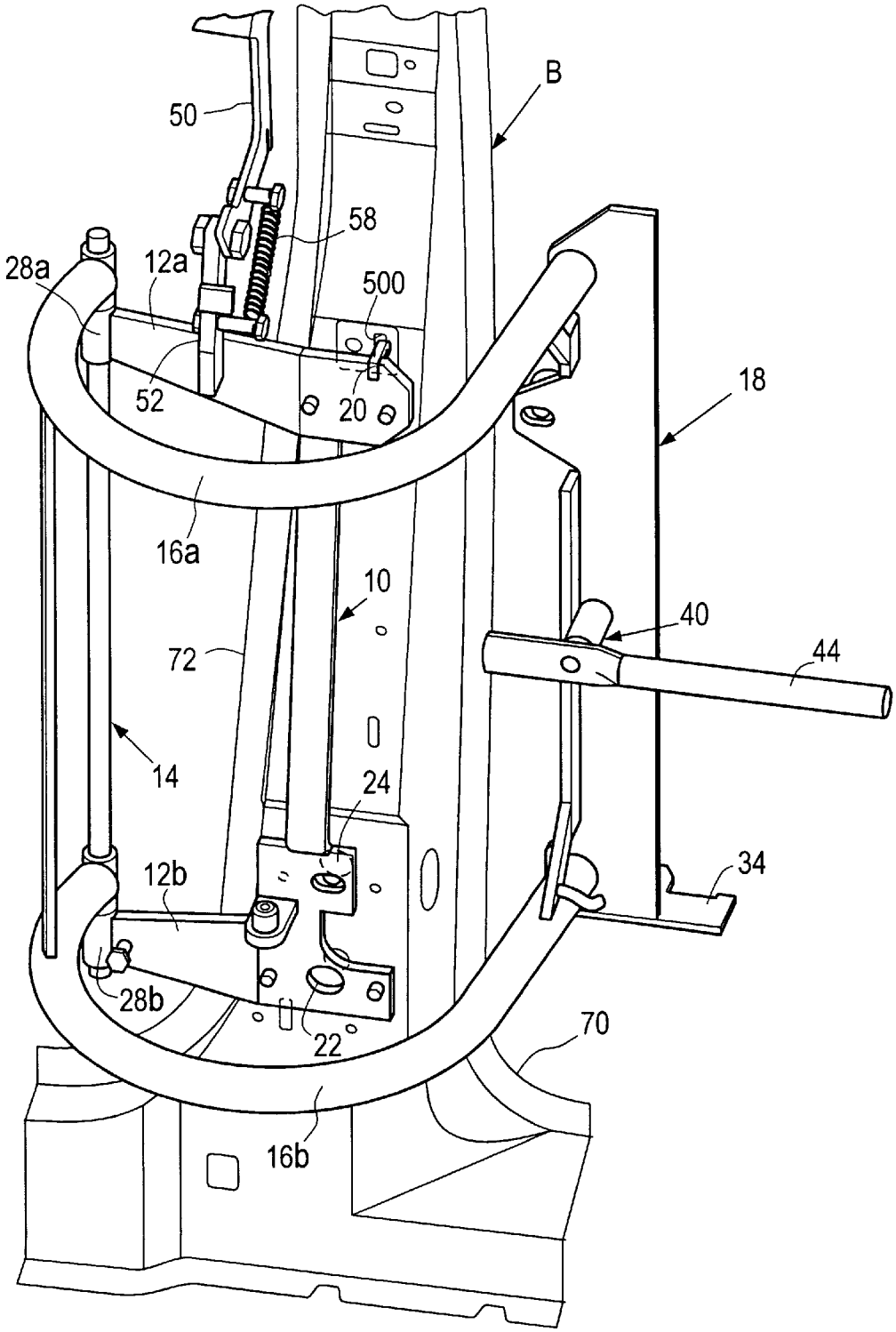
FIG. 5 is a perspective view of the device when assembled and as seen from within the vehicle.

The device shown in the drawings is adapted to momentarily mount a sliding door (not shown) to a vehicle body such that the sliding door can be pivoted between opening and closing positions in order to provide for easy access to the vehicle body and door so as not to impede working in the so-called finishing area and in particular in the paint shop during the manufacturing process. FIGS. 1 to 4 show the device by itself, whereas FIG. 5 shows the device in its assembled condition when it is removably secured to the so-called B column of the vehicle body so as to carry the (not shown) sliding door.

Terms such as vertical, horizontal, etc. as used in the following description refer to the assembled condition when the device has been secured to the B column.

The main components of the device shown in the drawings are an elongated securing member 10 adapted to be removably secured to an inner surface of the B column so as to extend vertically, an elongated holding member 18 adapted to removably hold the sliding door, a pair of transverse arms 12*a,* 12*b* extending from the securing member 10, a pair of round brackets 16*a,* 16*b* extending from the holding member 18, and vertically extending pivot means 14 for pivotally interconnecting the transverse arms 12*a,* 12*b* and the round brackets 16*a,* 16*b.*

The securing member 10 and the transverse arms 12*a,* 12*b* form a securing mechanism for removably securing the device to the B column. The holding member 18 and the round brackets 16*a,* 16*b* form a holding mechanism for removably holding the sliding door. The securing mechanism and the holding mechanism are pivotally connected to each other by the pivot means 14 such that the sliding door can be rotated with respect to the vehicle body by relative rotational movements of the securing mechanism and the holding mechanism as will be explained in more detail below.

The securing member 10 comprises a substantially vertically extending beam-like part 21 having a plate-like part 23 and a plate-like part 25 fixedly attached to its upper end and, respectively, lower end. Fixed to the upper plate-like part 23 is a hook 20 (FIG. 1) adapted to be engaged into a hole 500 at an inner surface of the B column (see FIG. 5). The lower plate-like part 25 is provided with a positioning pin 24 (FIG.

1) adapted to be engaged into a respective hole of the B column (FIG. 6) in order to position the securing member 10 and accordingly the total device relative to the B column. The lower plate-like member 25 of the securing member 10 is provided with a hole 22 (FIG. 1) through which a fastener such as a bolt (not shown) may be inserted into a respective threaded bore of the B column.

The transverse arms 12*a,* 12*b* extend transversely from the upper plate-like part 23 and, respectively, lower plate-like part 25 of the securing member 10 such that they extend from the B column towards a door opening 70 (see FIG. 5) for the sliding door.

The transverse arms 12*a,* 12*b* have at their free ends sleeve-shaped mounting portions 28*a,* 28*b* (FIGS. 1 and 2) receiving a unitary vertical pivot axis 26 of the pivot means 14. The round brackets 16*a,* 16*b* are provided with similar sleeve-shaped mounting portions 30*a,* 30*b* (FIGS. 1 and 2) for receiving the pivot axis 26 such that the transverse arms 12*a,* 12*b* and the round brackets 16*a,* 16*b* are hingedly connected to each other by means of the pivot axis 26.

The round brackets 16*a,* 16*b* are of semi-circular shape and extend when the device is mounted to the B column from the pivot means 14 about the inner side of the B column such that its ends remote from the pivot means and carrying the holding member 18 project into the door opening 70 (FIG. 5).

The two brackets 16*a,* 16*b* are connected to each other on the one hand by a vertically extending beam-like part 32 (FIGS. 1 and 3) and on the other hand by the vertically extending holding member 18 such that they form a frame-like structure. The holding member 18 which is formed as a unitary beam-like part has at its lower end a support 34 (FIGS. 1 and 4) comprising a sheet-like part provided with a holding finger 36 adapted to receive the sliding door. The holding member 18 is provided in its upper area with a positioning pin 38 (FIG. 1) adapted to be engaged into a respective hole of the sliding door so as to position the sliding door relative to the holding member 18.

Furthermore the holding member 18 is provided with actuatable locking means 40 (FIGS. 1 and 5) for locking the sliding door to the holding member 18. The locking means 40 comprises a locking member 42 pivotally mounted in a central area of the holding member 18 by pivot means 43 so as to be rotatable about a horizontal axis. The locking means 40 furthermore includes a manual handle 44 allowing to rotate the locking member 42 between locking and unlocking positions when the locking member 42 extends into a respective recess of the sliding door. A spring 46 (FIG. 1) provided at the holding member 18 allows the manual handle 44 to be fixed in the locking position.

As shown in the drawings, the parts 21, 23, 25, 12*a,* 12*b,* 18, 32, 34, 36 and 50 are made of sheet material whereas the brackets 16*a,* 16*b* are made of rod-shaped material of circular cross-section. The fixed connections between parts 21, 23, 25, 12*a,* 12*b* and between holding member 18 and support 34, between holding member 18 and brackets 16*a,* 16*b* and between member 32 and brackets 16*a,* 16*b* are obtained preferably by welding.

Operation of the device described above is as follows. In order to mount the device to the vehicle body the securing member 10 is secured to an inner surface of the B column by having hook 20 engage the B column by, inserting the positioning pin 24 into the respective hole of the B column and by moving a fastener through the hole 22 so as to threadingly engage the B column. Accordingly, in order to mount the device to the B column it is only one fastener that is to be tightened.

Thereafter the sliding door is secured to the holding member 18 by disposing the sliding door upon the support 34 and inserting the positioning pin 38 and the locking member 42 into the respective hole and recess of the sliding door, whereupon the manual lever 44 is rotated so as to move the locking member 42 into its locking position. Securing the sliding door to the device, therefore, is also extremely simple.

It is now possible to rotate the sliding door about the pivot axis 26 between opening and closing positions by rotating the holding mechanism comprised of the round brackets 16*a,* 16*b* and the holding member 18. Provided that rotation of the device is counteracted by sufficient frictional resistance of the pivot means 14 no additional means for retaining the sliding door in its various positions are required.

In special types of vehicles the rear doors are designed as sliding doors whereas the front doors are pivotally mounted to the vehicle body. When the device shown in the drawings is used for this type of vehicles, the device can be provided with a mechanism for retaining the front door in its closing and opening positions. To this end the device shown in the drawings is provided with a retaining lever 50 (FIGS. 1 to 5).

As indicated in FIG. 5 the transverse arms 12*a,* 12*b* extend in a direction towards a door opening 72 for the front door (not shown). This is why the retaining lever 50 is fixed to the upper transverse arm 12*a*. More specifically, the upper transverse arm 12*a* has fixed thereto a support piece 52 and the retaining member 50 is pivotally mounted to an upper end of the support piece 52 so as to be rotatable about a horizontal axis by pivot means 53.

Figure 1:
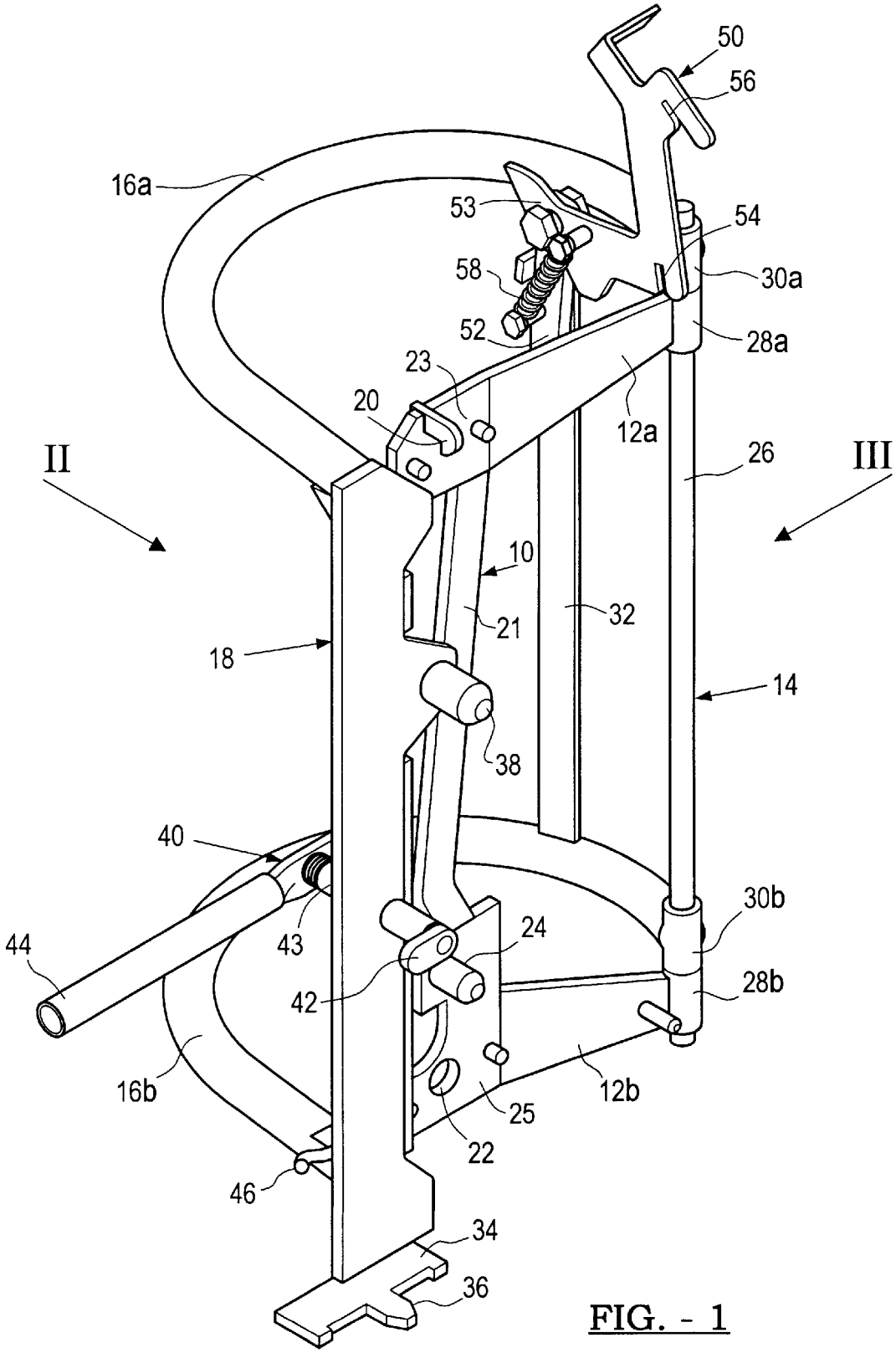
FIG. 1 is a perspective view of a device of the present invention as seen from the outside of the vehicle.
Figure 2:
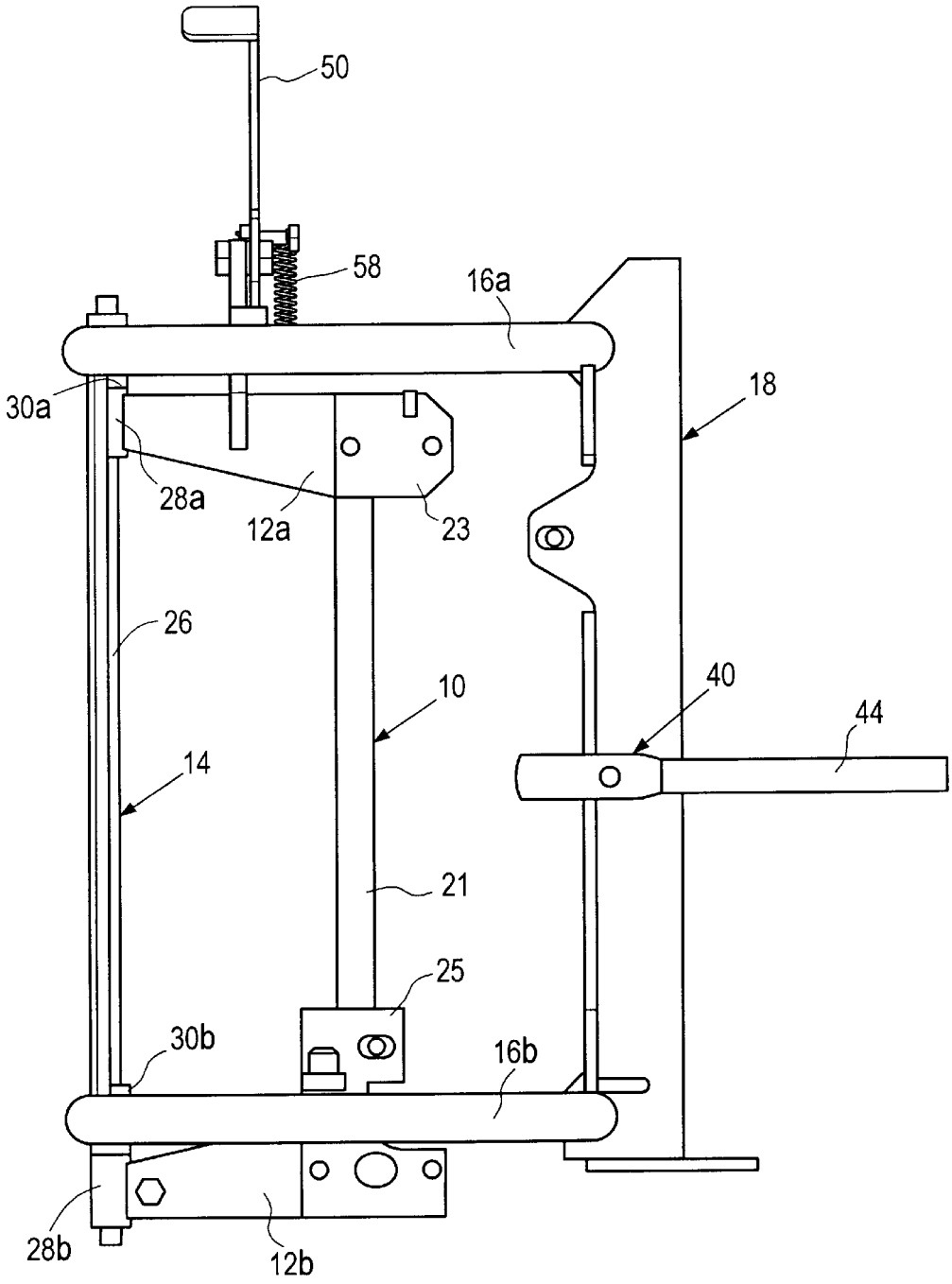
FIG. 2 is a side elevation of the device as seen in the direction of arrow II in FIG. 1.
Figure 3:
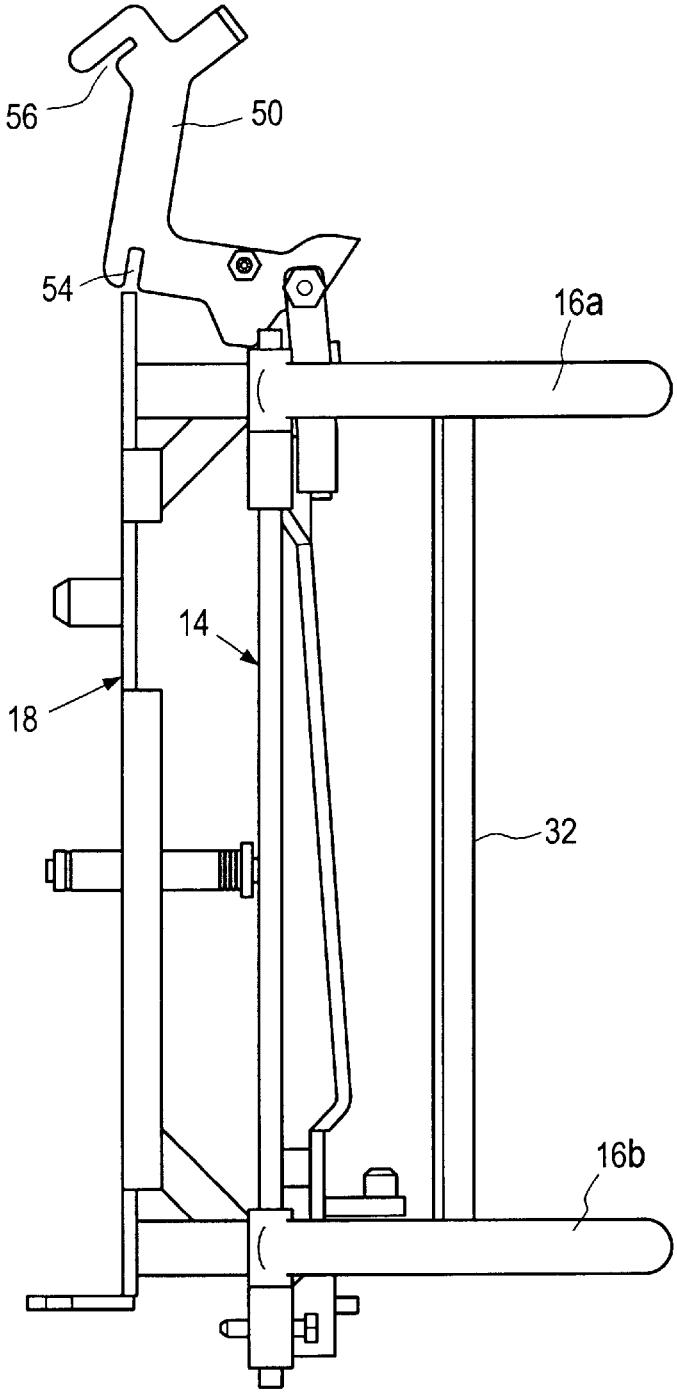
FIG. 3 is a side elevation of the device as seen in the direction of arrow III in FIG. 1.
Figure 4:
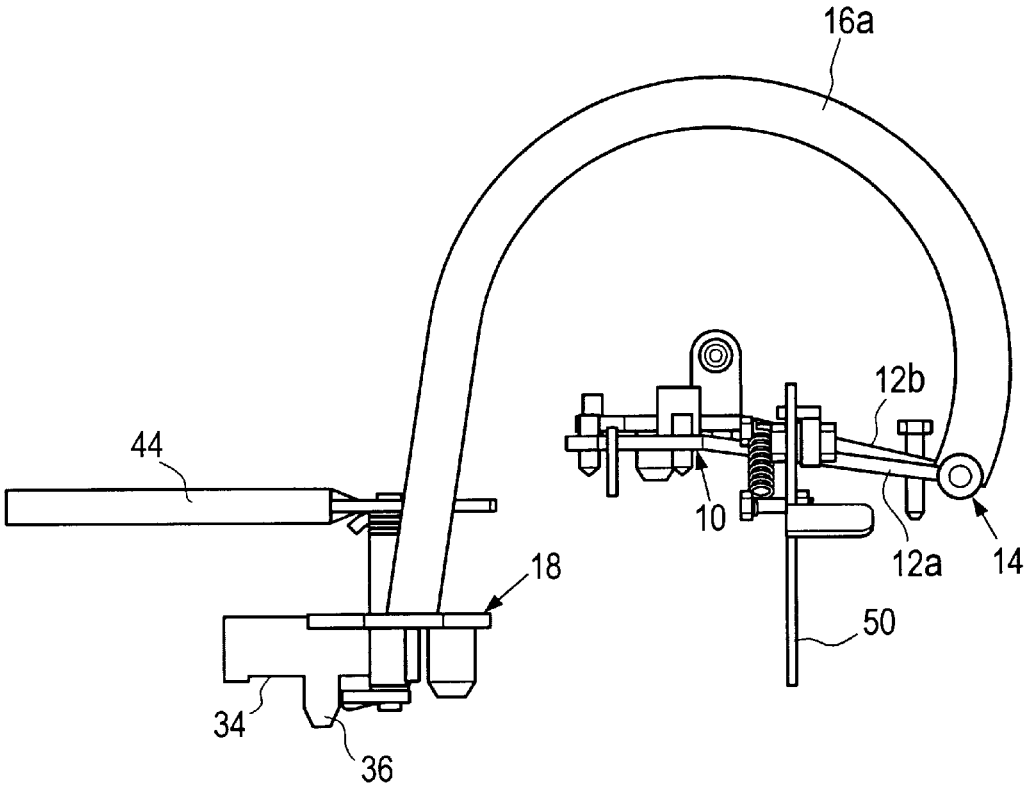
FIG. 4 is a view of the device from above.

The retaining lever 50 is generally L-shaped, with a slot 54 being provided at the location where the two legs of the L meet and a slot 56 being provided at the upper end of the retaining lever 50 (FIGS. 1 and 3). The retaining lever 50 is being biased by a tension spring 58 having its one end fixed to the support piece 52 and its other end fixed to the retaining lever 50.

The retaining lever 50 is displaceable against the bias of spring 58 between two positions, i.e. a first position wherein the slot 54 is engaged by the front door when it is in its closing position, and a second position wherein the slot 56 is engaged by the front door when it is in its opening position. In this manner the front door can be retained in each of its two positions.

What is claimed is:

1. A device for momentarily mounting a sliding door to the B column of a vehicle body, comprising a securing mechanism adapted to be removably secured to said B column, said securing mechanism including an elongated securing member adapted to be secured to an inner surface of said B column so as to extend vertically, and a pair of spaced transverse arms extending from said securing member transversely so as to extend away from said sliding door when said securing member has been secured to said B column;

a holding mechanism for removably holding said sliding door, wherein said transverse arms are substantially parallel to said sliding door when said sliding door is held in said holding mechanism, and pivot means for pivotally interconnecting said securing mechanism and said holding mechanism so as to enable said sliding door held by said holding mechanism to be rotated between opening and closing positions when said securing mechanism has been secured to said B column, said securing mechanism, said holding mechanism and said pivot means forming an integral structure.

2. The device as defined in claim 1 wherein said holding mechanism includes:

a pair of round brackets each having one end thereof pivotally connected to a free end of said transverse arms by said pivot means such that said round brackets extend about the B column within said vehicle when said securing member has been secured to said B column, and an elongated holding member being fixedly connected to respective other ends of said round brackets and adapted to removably hold said sliding door.

3. The device as defined in claim 2 wherein said pivot means include a vertical pivot axis having opposite ends hingedly connected to respective ends of said transverse arms and said round brackets.

4. The device as defined in claim 2 wherein said holding member includes:

a transverse bottom support for supporting said sliding door and actuatable locking means for locking said sliding door to said holding member.

5. The device as defined in claim 4 wherein said actuatable locking means include a locking member adapted to be manually rotated between a locking position wherein it engages a recess of said sliding door and an unlocking position wherein it is disengaged from said recess of said sliding door.

6. The device as defined in claim 4 wherein said holding member further includes a positioning pin adapted to be inserted into a hole of said sliding door so as to position said sliding door relative to said holding member.

7. The device as defined in claim 1 wherein said securing member includes:

a hook adapted to be engaged in said B column, and a hole for receiving a fastener for fastening said securing member to said B column.

8. The device as defined in claim 7 wherein said securing member includes a positioning pin adapted to be inserted into a hole of said B column so as to position said securing member relative to said B column.

9. The device as defined in claim 1 for use with a sliding door which is a rear door of a vehicle having a pivotal front door, wherein said securing mechanism has pivotally mounted thereto a resiliently biased holding lever adapted to hold said front door in closing and opening positions.

10. The device as defined in claim 9 wherein said holding lever includes a first slot for engaging said front door when it is in its closing position, and a second slot for engaging said front door when it is in its opening position.

* * * * *